US005219142A

United States Patent [19]

Potter

[11] Patent Number: 5,219,142

[45] Date of Patent: Jun. 15, 1993

[54] NEW ARTIST'S EASEL

[76] Inventor: David J. Potter, 13 High Street, Loddon, Norfolk, United Kingdom

[21] Appl. No.: 698,002

[22] Filed: Jun. 9, 1991

[30] Foreign Application Priority Data

May 9, 1990 [GB] United Kingdom ..... 9010420

[51] Int. Cl.[5] ..... A47B 97/08

[52] U.S. Cl. ..... 248/454; 248/460; 248/458; 248/448; 248/163.1

[58] Field of Search ..... 248/454, 455, 441.1, 248/448, 449, 458, 457, 460, 463, 163.1

[56] References Cited

U.S. PATENT DOCUMENTS 3,114,215 12/1963 Turkin ..... 248/449
3,926,398 12/1975 Vincent ..... 248/460 X
4,165,856 8/1979 Wiseheart ..... 248/449
4,690,363 9/1987 Koves ..... 248/454

FOREIGN PATENT DOCUMENTS 2384900 11/1978 France ..... 248/448

*Primary Examiner*—Alvin C. Chin-Shue

[57] ABSTRACT

An artist's easel comprising a framework adapted to receive and hold a canvas; one or more wheels mounted on the framework and enabling the easel to be wheeled to and from a place of use; means for maintaining the frame in its normally intended attitude of use; and means which, in use, engage the ground on which the easel stands to resist any tendency of the easel to move along the ground, characterised by the feature that the easel, as well as being height-adjustable by moving at least a portion of the frame, can also swivel about the frame axis.

9 Claims, 4 Drawing Sheets

NEW ARTIST'S EASEL

BACKGROUND OF THE INVENTION

The invention relates to artists' easels and is concerned with novel and inventive improvements to the artists' easel shown in published United Kingdom patent specification number 2,211,083. This published specification and the prior specifications brought forward against it by the United Kingdom Patent Office in their preliminary examination and search of it, constitute the most relevant art known to the applicant.

SUMMARY OF THE INVENTION

According to the present invention there is provided an artist's easel comprising a framework adapted to receive and hold a canvas; one or more wheels mounted on the framework and enabling the easel to be wheeled to and from a place of use; means for maintaining the frame in its normally intended attitude of use; and means which, in use, engage the ground on which the easel stands to resist any tendency of the easel to move along the ground, characterised by the feature that the easel, as well as being height-adjustable by moving at least a portion of the frame, can also swivel about the frame axis.

Preferably the easel is height-adjustable by moving the upper portion of the frame relative to the lower portion of the frame.

The easel can preferably swivel about two mutually perpendicular axes in such a way that the upper, canvas-carrying, portion of the frame can be fixed at or in a horizontal working plane.

An easel as described above may be additionally characterised by the feature that firstly the attitude-maintaining means comprises a single prop which is foldable relative to the frame so as to fold down against the frame for transport, secondly that this prop occupies an in-use position in which it projects from the frame at a fixed angle, and thirdly that the prop projects from the lower and not the upper portion of the frame in use.

The easel described in the immediately preceding paragraph may be further characterised by the feature that the prop is a variable-length prop.

The easel described above is preferably characterised by the provision of means for transporting an artist's equipment from place-to-place.

According to the present invention there is also provided an artist's easel comprising a framework adapted to receive and hold a canvas; one or more wheels mounted on the framework and enabling the easel to be wheeled to and from a place of use; means for maintaining the frame in its normally intended attitude of use; and means which, in use, engage the ground on which the easel stands to resist any tendency of the easel to move along the ground, characterised by the feature that the easel, as well as being height-adjustable by moving at least a portion of the frame, can also swivel about the frame axis; and in which the upper, canvas-supporting, portion of the frame is separately height-adjustable relative to the remainder of the framework.

The easel described in the immediately preceding paragraph may be additionally characterised by the feature that the canvas-supporting portion of the frame includes canvas locating means that can be moved and securely located relative to the canvas-supporting portion of the frame to accommodate different size canvasses.

The easel described above is preferably characterised by the provision of means for transporting an artist's equipment form place-to-place.

Figure 3:
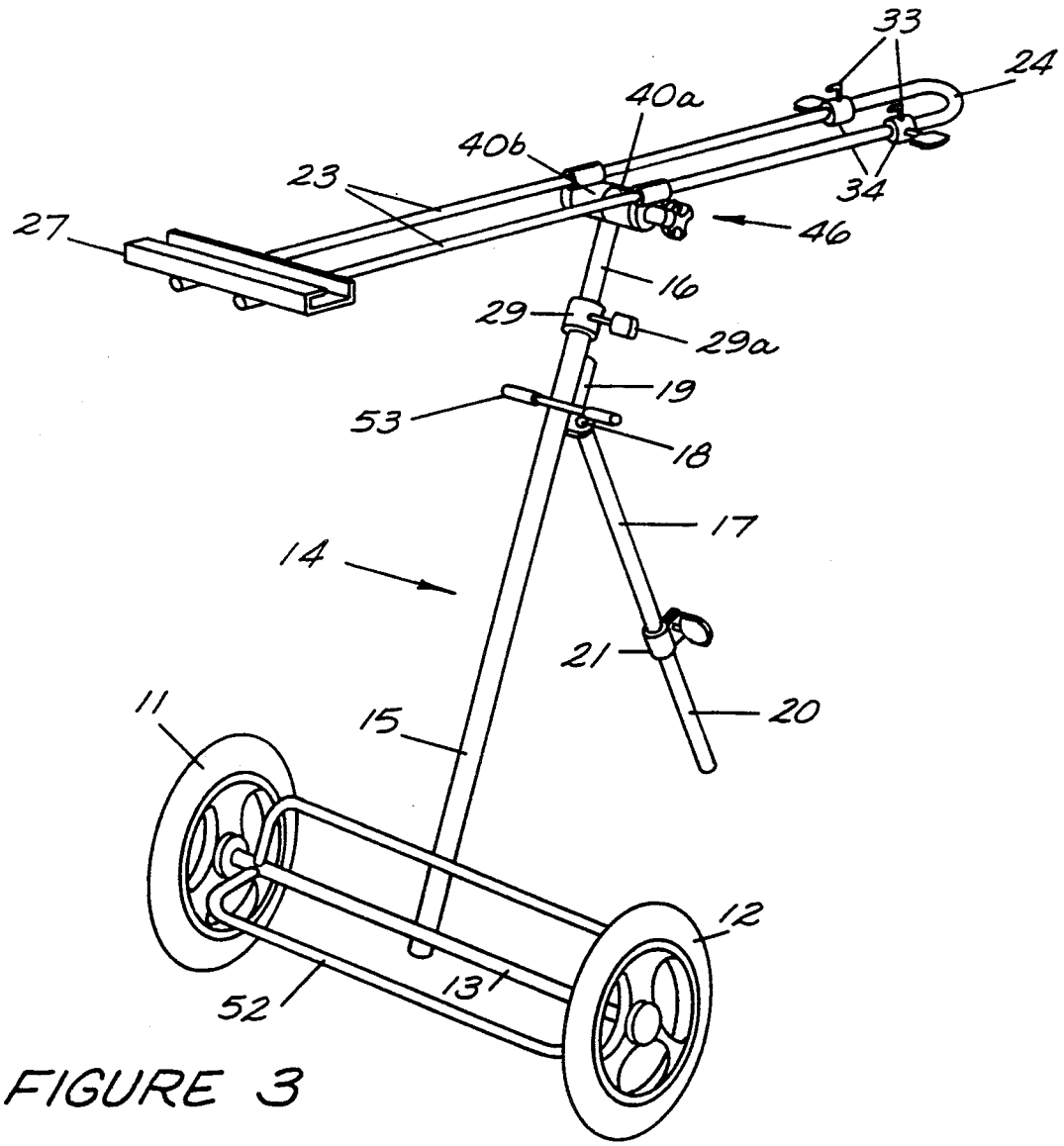
FIG. 3 is a perspective view of a second embodiment of the new easel showing the canvas support unit in a generally horizontal position.

FIG. **4*a* is a perspective view of an alternate clamp and canvas support for the upper end of FIG. 3**.

Figure 4:
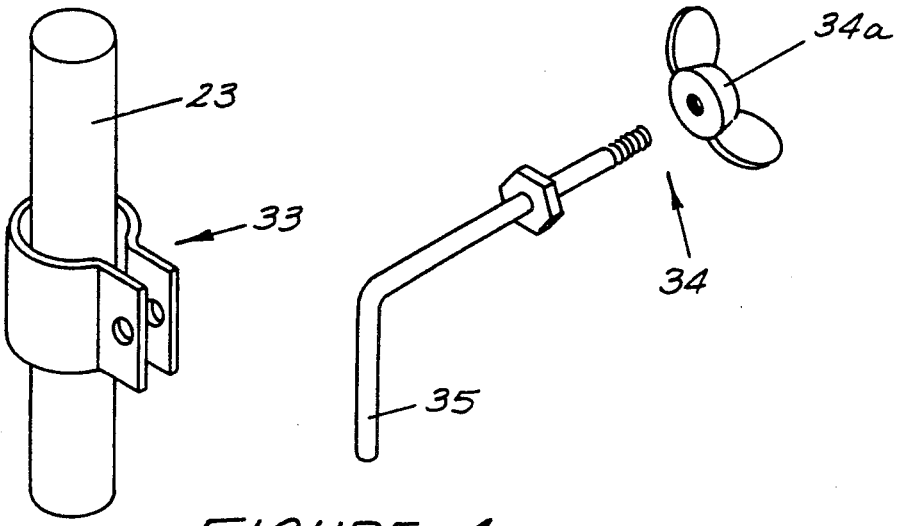
FIG. 4 is a detail exploded view of the clamp and canvas support at the upper end of FIG. 3.
Figure 4A:
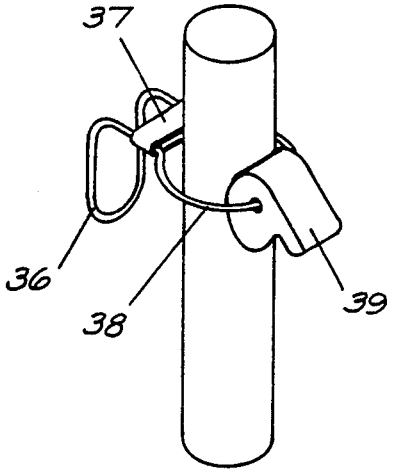
Figure 4B:
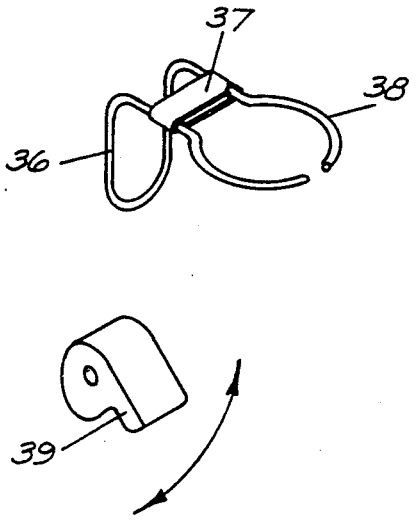

FIG. 4B is a detail exploded view of the clamp and canvas support shown in FIG. 4B.

Figure 5:
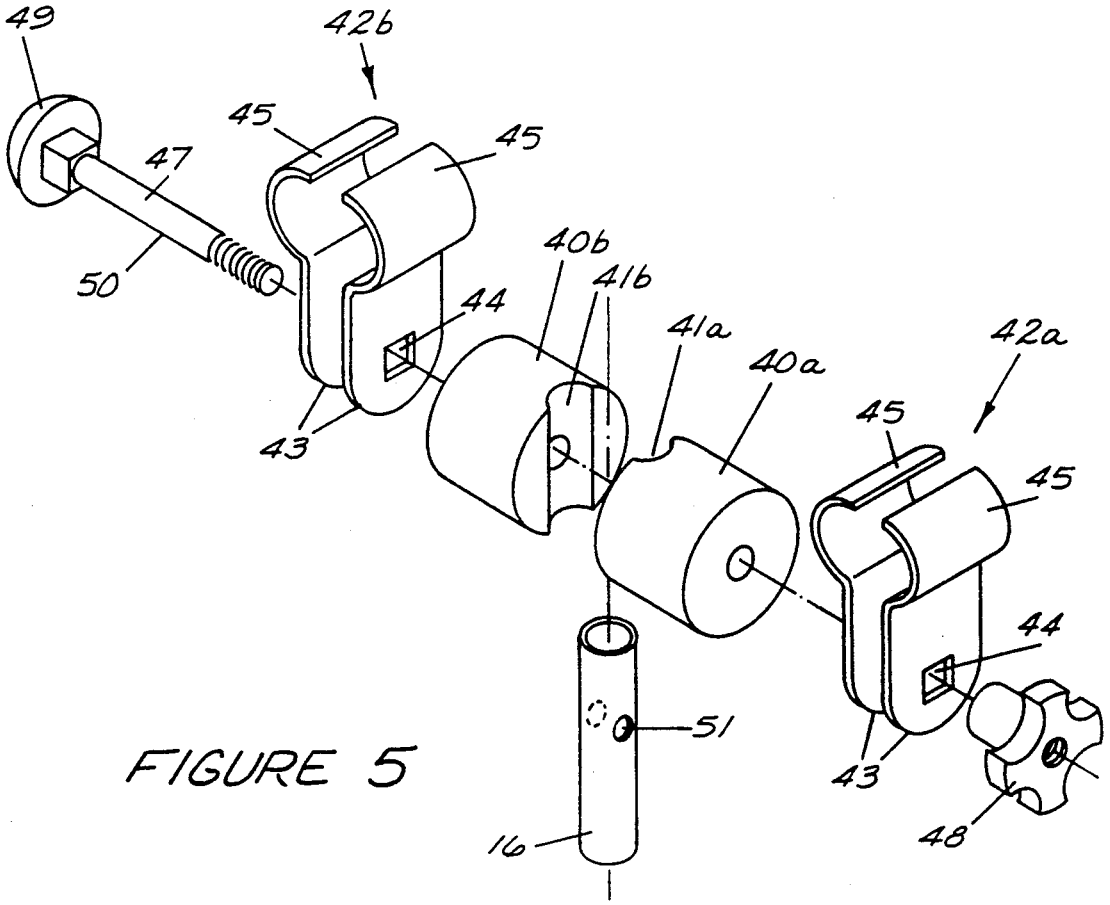

FIG. 5 is an enlarged "exploded" view of the mounting assembly shown in the area marked V in FIG. 3.

DESCRIPTION OF THE PREFERRED EMBODIMENTS

An artist's easel consists of wheels 11, 12 spaced apart by a rigid axle 13 supporting a mast 14. The mast 14 is telescopic with the stem outer 15 of the telescope fixed to the axle 13 and the barrel 16 of the telescope sliding within the stem 15. The stem 15 forms the base of the mast 14 whilst the barrel 16 forms the extensible and retractable arm of the mast. The stem 15 is detachable from the axle 13.

Pivoted towards the top of the stem 15 of the mast 14 is a support 17 which extends from the stem towards the wheels 11, 12 and rigid axle 13. The support 17 can be swung about its pivot 18 in a direction away from the wheels 11, 12 and axle 13 to form, with the wheels 11, 12 a three-point ground contact, supporting the mast 14 at an angle to the ground on which the easel stands. The support 17 when in its intended position of use is kept at a fixed angle to the ground by stop 19 which impinges against the stem 15. The angle at which the easel stands relative to the ground may be altered using the extendible leg 20 which is releasably clamped in position using a screw-threaded hand-operated conventional clamp 21. Stop 19 is an integral extension of support 17. The leg 20 may be held in place, when pivoted towards the mast 14, by a flexibly resilient plastics clip (not shown).

An angle bar 22 is fixed non-adjustably to extensible and retractable U-shaped arms 23 of the canvas support unit. The base of the U forms a handle 24 by which the easel can be pulled along the ground when the extensible leg 20 of the support 17 is retracted and clamped with clamp 21. Leg 20 can swing flat against stem 15 of the mast for compact stowage.

Each arm of the U 23 fits telescopically into a casing 25. Two clamps 26 which are screw-threaded and hand-operated allow the distance between the fixed angle bar 22 and the bottom canvas support bar 27 to be altered to suit the size of the canvas on which the artist is working.

Figures 1, 1A:
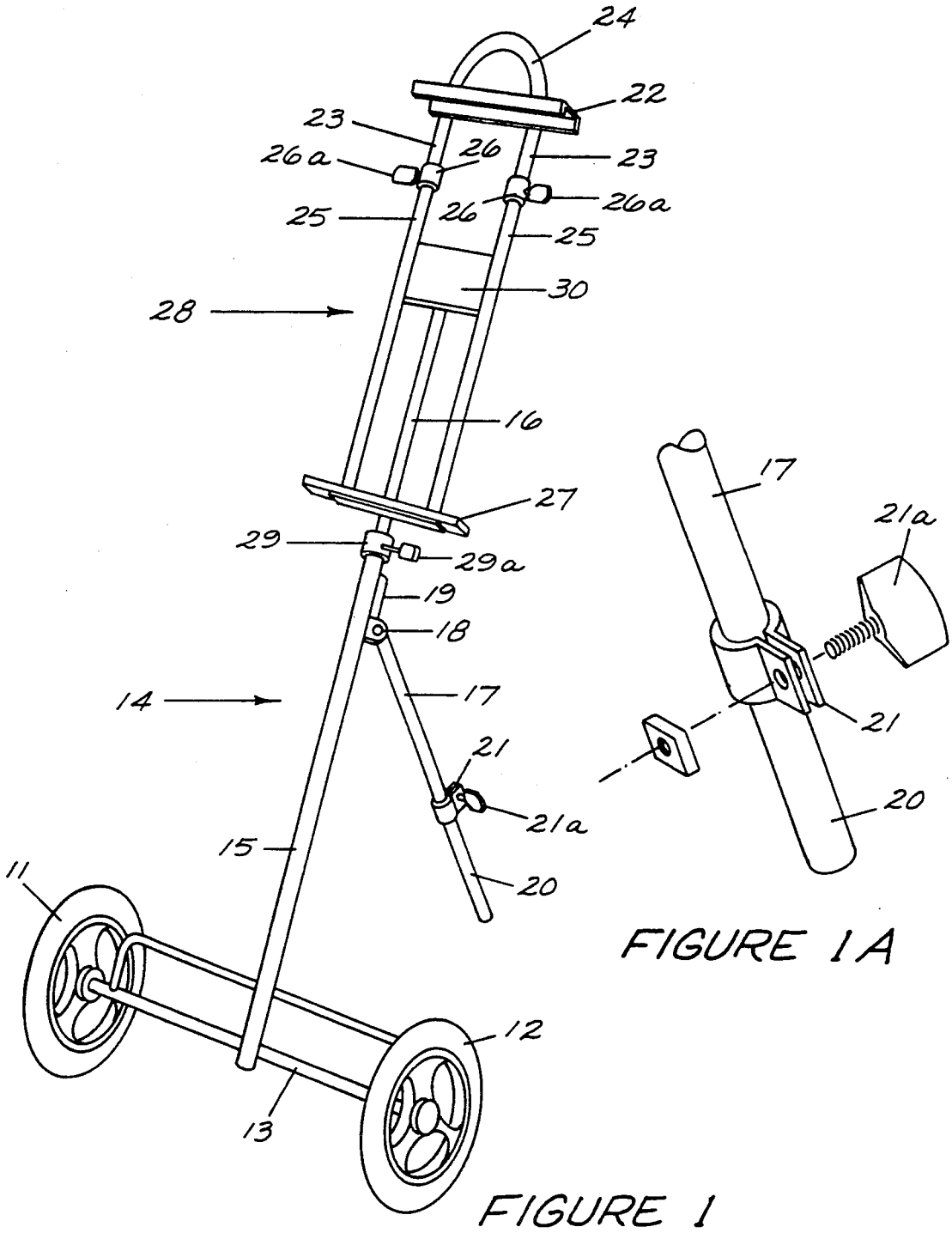
FIG. 1 is a perspective view of the new easel showing the canvas support in a generally vertical position.
FIG. 1A is a detail exploded view of the tightening clamp for the supporting leg in FIG. 1.
Figure 2A:
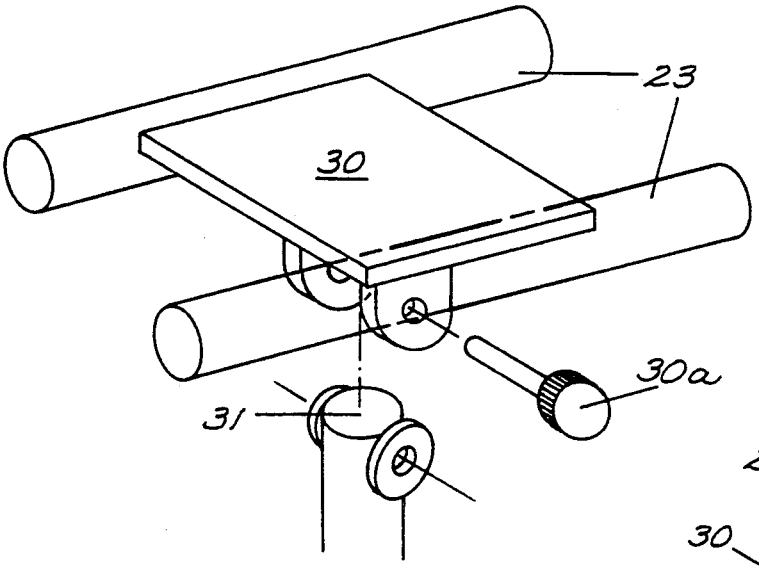
FIG. 2A is a detail exploded view of the connection for the canvas support unit at the top of FIG. 2.
Figure 2:
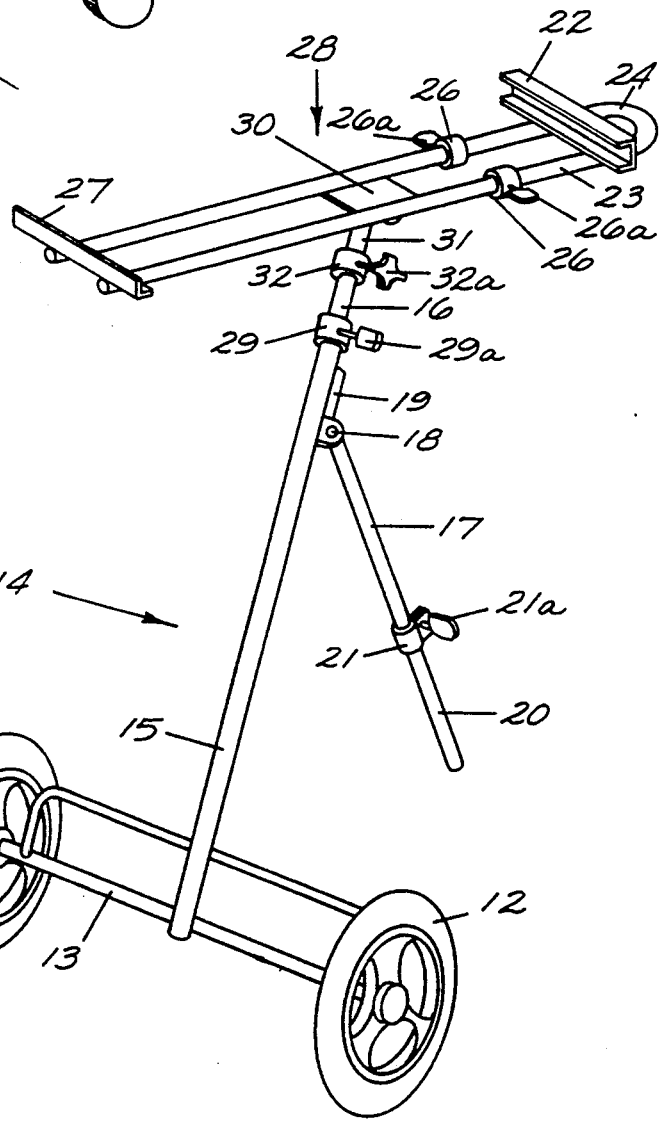
FIG. 2 is a perspective view of the new easel showing the canvas support unit in a generally horizontal position.

Referring now to FIG. 2. The mast 14 consists of a telescopic barrel 16 which is extensible and retractable and which is held in a selected position by a screw-threaded hand-operated clamp 29; which is a conventional ring clamp.

The canvas support unit 28, which is formed by a parallel bar "casing" 25 and the upper-canvas-edge supporting bar 22 and lower-canvas-edge supporting bar 27, is mounted onto the top of the telescopic barrel 16 via plate 30 and strut 31 so that it has a range of movements. The canvas support unit 28 can swivel through 360° in the horizontal plane, including a canvas-vertical and a canvas-horizontal position. A screw-threaded hand-operated conventional ring clamp 32, when loosened, allows the canvas support unit 28 to be moved into an appropriate-position-and when this position is reached, to be tightened to hold the canvas support unit 28 in its selected position. The enlarged-scale "exploded" view shows this in detail.

The components 15 and 16 are both a close up-and-down sliding fit one within another, and are both circular-cylindrical. Clamp 29 thus allows barrel 16 to swivel, about its own axis, within stem 15. As frame 28 is fixed to the top of barrel 16, frame 28 can therefore swivel about two mutually perpendicular axes—the respective axes of the screw-threaded clamping hand-wheel of clamp 32, and of mast 14.

Clamps 21, 26 and 29 are identical in operation, as shown in the enlarged views in the drawings. Clamp 32 differs, again as shown, in that it is operated by a hand-wheel instead of by thumbscrews, although its clamping action is essentially the same.

A second embodiment is shown in FIG. 3, like numerals referencing like components where appropriate. In this embodiment the canvas-supporting unit is modified to simplify the design and to reduce the manufacturing costs.

The U-shaped arms 23 comprise a single piece of bent cylindrical tubing in this embodiment. The lower angle bar 27 located near the ends of the arms 23 is fixed in position, whilst the upper canvas-supporting means 33 (comprising angle bar 22 in the first embodiment) (a capable of movement relative to the arms 23 and of being secured thereto by screw-threaded hand-operated clamps 34. As shown in FIG. 4 each canvas-supporting means 33 comprises a bent rod 35 which forms a pin of the clamp 34 in this embodiment. This construction allows different sized canvasses to be easily accommodated.

FIG. 4 also illustrates an alternative upper canvas-supporting means 33 including a bent rod 36 joined at 37, and including a circlip portion 38. The clamp 34 is located using the hand-operated cammed over-centre locking device 39.

Another significant alteration between the two embodiments is to the canvas supporting unit mounting assembly (which is based around the plate 30 in the first embodiment).

In this second embodiment the mounting assembly—shown clearly in the FIG. 5 enlarged scale "exploded" view—is based around a two part (wooden) block 40*a, b;* each part of the block being substantially cylindrical with a semi-cylindrical recess 41*a, b* adapted to fit around the barrel 16.

Spaced apart by the block parts 40*a, b* are two cup clamps 42*a, b* so shaped and sized as to be able to grip the arms 23. The clamps 42*a, b* are coated with polyvinyl chloride (PVC) plastics to increase their scratch resistance and their coefficient of friction with respect to the arms 23 to ensure secure location of the canvas-supporting unit. Each cup clamp 42*a, b* comprises a plate member 43 in which there is a square hole 44, and a substantially semi-circular (in section) cup member 45.

The mounting assembly is securely located with respect to the barrel 16 by a clamp 46 which comprises a bolt 47 and a handwheel 48. The bolt 47 comprises a head 49 and a shank 50 a minor part of which, adjacent the head 49, is square (in section) to locate in holes 44 in cup clamps 42*a, b*. The bolt 47 includes an exterior thread at its end distant from the head 49 whilst the handwheel 48 includes an interior thread to engage the bolt 47. The barrel 16 includes two aligned circular holes 51 through which the bolt 47 passes to secure the mounting assembly to the barrel 16. A plastics cover-cap normally present over the end of the barrel 16 is omitted in this Figure for clarity.

This construction simplifies the rotational (relative to the axis of the bolt 47) positioning of the canvas-supporting unit. This embodiment also enables independent height adjustment of the canvas-supporting unit relative to the remainder of the easel.

Other alterations between the two embodiments include a substantially horizontal (in use) support bar 52 on the axle 13; this provides means for transporting artist's equipment (e.g. spare canvasses, a stool etc.) over and above the storage and transportation capacity of the frame-carrying portion—a bar 52 may be added to the first embodiment. In this embodiment the axle 13 is located on the side of the mast 14 distant from the support 17 and is releasably attached to the mast 14 by a screw-threaded hand-operated clamp (not shown). In order to protect the stem 15 a protective solid bar 53 having elastomeric end-covers positioned to engage U-bar 23 is welded to the structure of pivot 18. The collapsibility of the easel allows it to be conveniently stored and packaged in so-called flat-pack form.

In order to assist and increase the storage and transportation capacity of the easel elasticated cords may be provided often with hooks on either end of the cord, to aid in carrying various items.

All the elongate components of the easel illustrated are tubular and circular-cylindrical, with the exception of bars 22 and 27 which are lengths of right-angled bar, and of protective bar 53.

I claim:

1. An artist's easel comprising a framework comprising a horizontally oriented base member, a pair of wheels mounted on opposite ends of said base member enabling said easel framework to be wheeled to and from a place of use, said wheels contacting the ground during use as well as during wheeled movement of said easel;

an elongated tubular frame member secured on and extending normal to said base member and having a distal end extending upward in use, a supporting pivot on the distal end of said frame member, an elongated tubular leg member having a leg portion having a ground-engaging distal end and a bent end portion and supported at the bend for pivotal movement on said pivot, said bent end portion being positioned away from said frame member when said leg portion is in a stored position against said frame member and engages said frame member as a stop to predetermine the angle of said leg member relative to said frame member when said leg member is moved outward for use, said wheels and said leg member distal end engaging the ground during use to provide a three point support and cooperating to resist movement along the ground, a tubular supporting member telescoped inside the distal end of said frame member for adjustment of a distal end relative thereto, and an easel comprising upper and lower supporting means interconnected and supported on said supporting member distal end for pivotal and rotary movement.

2. An easel according to claim 1 in which said tubular supporting member being rotatable in said frame member distal end portion, and said frame member distal end portion includes locking means for locking said tubular supporting member at a predetermined rotary or extended position therein.

3. An easel according to claim 2 in which said easel upper and lower supporting means are parallel and have interconnecting parallel telescoping supporting rods adjustable to predetermine the spacing of said supporting means, and said parallel supporting rods being supported on said supporting member distal end for pivotal movement thereon.

4. An easel according to claim 3 in which said easel upper and lower supporting means comprise parallel angle members supported laterally on said interconnecting parallel telescoping supporting rods.

5. An easel according to claim 3 in which said easel lower supporting means comprises an angle member supported laterally on the outer ones of said interconnecting parallel telescoping supporting rods, said easel upper supporting means comprises downwardly directed square hook members supported on the inner ones of said interconnecting parallel telescoping supporting rods, and said upper and lower easel supporting means being positioned to clamp the parallel sides of a picture frame or board.

6. An easel according to claim 3 in which said parallel interconnecting supporting rods include locking means for locking them at a predetermined extended position.

7. An easel according to claim 2 in which said easel upper and lower supporting means are parallel and have interconnecting parallel telescoping supporting rods adjustable to predetermine the spacing of said supporting means, a flat rectangular plate supporting the outer ones of said interconnecting parallel telescoping supporting rods, and said flat rectangular plate being supported on said supporting member distal end for pivotal movement thereon.

8. An easel according to claim 1 in which said elongated tubular leg member is variable in length to predetermined the angle of said easel in use.

9. An easel according to claim 8 in which said elongated tubular leg member comprises two telescoping tubular leg members variable in length to predetermine the angle of said easel in use, and locking means for locking said telescoping tubular leg members at a predetermined extended position.

* * * * *